US009436131B1

(12) United States Patent
Oba et al.

(10) Patent No.: US 9,436,131 B1
(45) Date of Patent: Sep. 6, 2016

(54) IMAGE FORMING APPARATUS AND CONTAINER FOR DEVELOPER

(71) Applicant: FUJI XEROX Co., Ltd., Minato-ku, Tokyo (JP)

(72) Inventors: Shota Oba, Kanagawa (JP); Shigeru Inaba, Kanagawa (JP); Norihiro Tamazawa, Kanagawa (JP); Ayumi Noguchi, Kanagawa (JP); Makoto Kanno, Kanagawa (JP); Seigo Shinozaki, Kanagawa (JP); Keisuke Kubo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/852,756

(22) Filed: Sep. 14, 2015

(30) Foreign Application Priority Data

Mar. 6, 2015 (JP) ..... 2015-044762

(51) Int. Cl.
*G03G 15/08* (2006.01)

(52) U.S. Cl.
CPC ..... *G03G 15/0898* (2013.01)

(58) Field of Classification Search
CPC ..... G03G 15/0898
USPC ..... 399/106
See application file for complete search history.

(56) References Cited

U.S. PATENT DOCUMENTS

2007/0160394 A1* 7/2007 Taguchi ..... G03G 15/0886 399/262
2014/0241752 A1* 8/2014 Goto ..... G03G 15/0875 399/106

FOREIGN PATENT DOCUMENTS

JP 11-311918 A 11/1999

* cited by examiner

*Primary Examiner* — Walter L Lindsay, Jr.
*Assistant Examiner* — Philip Marcus T Fadul
(74) *Attorney, Agent, or Firm* — Sughrue Mion, PLLC

(57) ABSTRACT

A container for developer detachably mountable to an image forming apparatus body includes a rotating body that contains developer and is rotated about a rotational center when drive is transmitted from the apparatus body, a discharge member that supports the rotating body such that the rotating body is rotatable relative to the discharge member and has a discharge port through which the developer is discharged, an anti-leakage member that is disposed in one of the rotating body and the discharge member and suppresses leakage of the developer, and a compressing portion that has a first side and a second side farther from the rotational center than the first side, is disposed in the other of both, and is pressed against the anti-leakage member to compress the anti-leakage member such that a compressing amount is larger on the second side than on the first side.

3 Claims, 8 Drawing Sheets

IMAGE FORMING APPARATUS AND CONTAINER FOR DEVELOPER

CROSS-REFERENCE TO RELATED APPLICATIONS

This application is based on and claims priority under 35 USC 119 from Japanese Patent Application No. 2015-044762 filed Mar. 6, 2015.

BACKGROUND

Technical Field

The present invention relates to an image forming apparatus and a container for developer.

SUMMARY

According to an aspect of the present invention, a container for developer detachably mountable to an image forming apparatus body includes a rotating body that contains developer and that is rotated about a rotational center when drive is transmitted from the image forming apparatus body, a discharge member that supports the rotating body such that the rotating body is rotatable relative to the discharge member and that has a discharge port through which the developer is discharged, an anti-leakage member that is disposed in one of the rotating body and the discharge member and that suppresses leakage of the developer, and a compressing portion that has a first side and a second side farther from the rotational center of the rotating member than the first side, that is disposed in the other of the rotating body and the discharge member, and that is pressed against the anti-leakage member so as to compress the anti-leakage member such that a compressing amount is larger on the second side than on the first side.

BRIEF DESCRIPTION OF THE DRAWINGS

Exemplary embodiments of the present invention will be described in detail based on the following figures, wherein:

FIG. 7A is the explanatory view of a state in which the rotating body is inclined, FIG. 7B is the explanatory view of part around the seal of a related-art structure, and FIG. 7C is the explanatory view of part around the seal according to the first exemplary embodiment.

DETAILED DESCRIPTION

Figure 1:
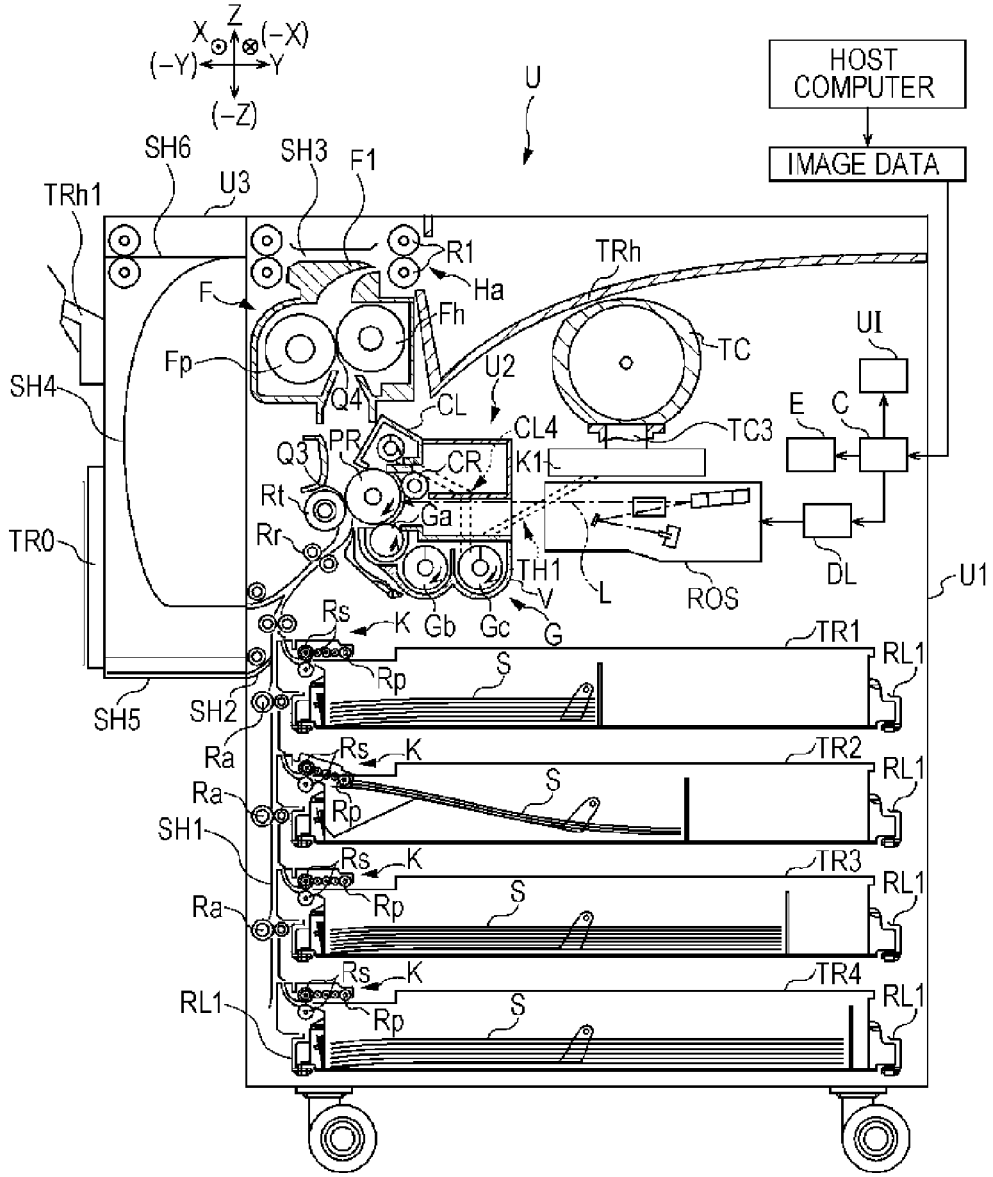
FIG. 1 is an overall explanatory view of an image forming apparatus according to a first exemplary embodiment.

Next, specific examples of exemplary embodiments of the present invention (referred to as exemplary embodiments hereafter) will be described with reference to the drawings. It is to be understood that the present invention is not limited to the following exemplary embodiments.

For ease of understanding of the description hereafter, the front-rear direction, the left-right direction, and the vertical direction in the drawings are respectively defined as the X direction, the Y direction, and the Z direction. Directions or sides indicated by arrows X, −X, Y, −Y, Z, and −Z respectively indicate the front, rear, right, left, upper, and lower directions or sides.

Also, circles marked with dots therein and circles marked with "x" s therein illustrated in the pages of the drawings respectively indicate arrows extending from the back side to the front side of the pages and arrows extending from the front side to the back side of the pages.

It is noted that, in the following description with reference to the drawings, elements other than those required for the description may be omitted from the drawings as appropriate for ease of understanding.

First Exemplary Embodiment

FIG. 1 is an overall explanatory view of an image forming apparatus according to a first exemplary embodiment.

In FIG. 1, a printer U that serves as an example of the image forming apparatus according to the first exemplary embodiment includes a printer body U1 that serves as an example of an image forming apparatus body. A first output tray TRh that serves as an example of a first medium output unit is provided in an upper surface of the printer body U1. An operation unit UI is provided in the upper surface of a right portion of the printer body U1. The operation unit UI includes components such as a display (not illustrated). The operation unit UI allows a user to perform an input operation therewith.

A host computer is illustrated as an example of an image information transmitting device for the printer U according to the first exemplary embodiment, and specifically, a personal computer is electrically connected to the printer U.

The printer U includes a controller C that serves as an example of a controller. The controller C is capable of receiving electrical signals such as image information and a control signal transmitted from the personal computer PC. The controller C is also capable of outputting control signals to the operation unit UI and a power source circuit E. Furthermore, the controller C is electrically connected to a writing circuit DL.

The writing circuit DL outputs a driving signal to a light exposure device ROS in accordance with information input thereto. The light exposure device ROS serves as an example of a writing device. The light exposure device ROS is capable of outputting a laser beam L in accordance with a signal input thereto. The laser beam L serves as an example of writing light.

Figure 2:
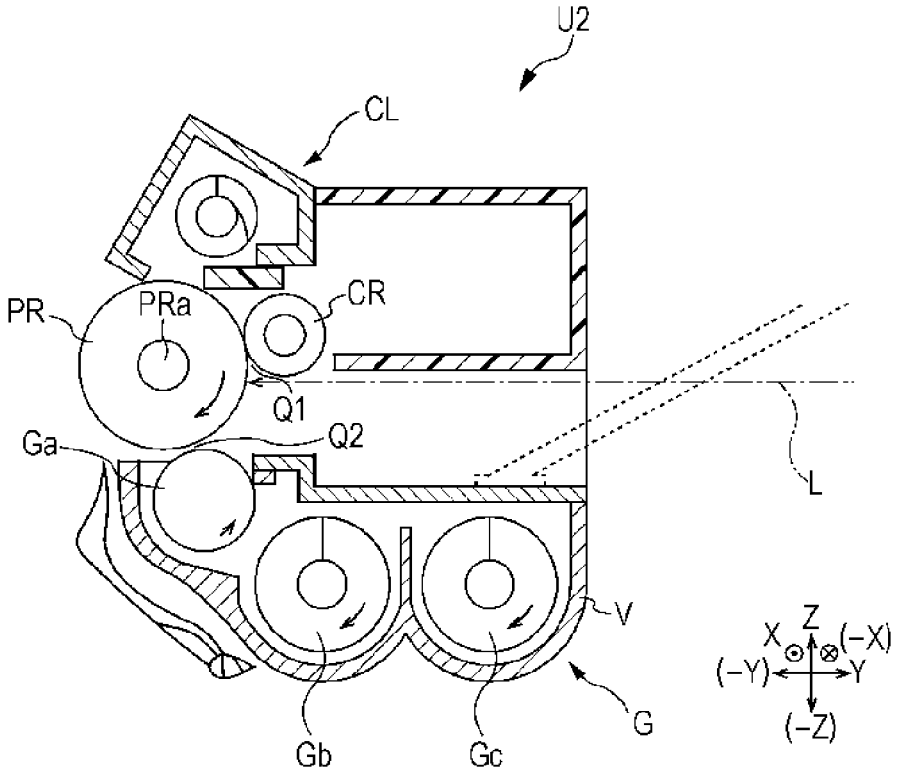
FIG. 2 is an enlarged view of part of a toner image forming device illustrated in FIG. 1.

FIG. 2 is an enlarged view of part of a toner image forming device illustrated in FIG. 1.

Referring to FIGS. 1 and 2, a photosensitive body PR that serves as an example of an image holding body is disposed to the left of the light exposure device ROS. The photosensitive body PR according to the first exemplary embodiment is supported such that the photosensitive body PR is rotatable about a rotational shaft PRa in an arrow direction. The photosensitive body PR has a writing region Q1 that is irradiated with the laser beam L.

A charging roller CR, a developing device G, and a photosensitive-body cleaner CL are arranged in a rotational direction of the photosensitive body PR around the photosensitive body PR. The charging roller CR serves as an example of a charging member. The photosensitive-body cleaner CL serves as an example of a cleaning device for the image holding body.

In the printer U according to the first exemplary embodiment, the photosensitive body PR, the charging roller CR, the developing device G, and the photosensitive-body cleaner CL are integrated with one another to form a unit that is detachably attached. That is, the photosensitive body PR, the charging roller CR, the developing device G, and the photosensitive-body cleaner CL are included in a process unit U2 that is detachably attached to the printer body U1.

A charging voltage is applied from the power source circuit E to the charging roller CR.

The developing device G includes a developing container V therein. The developing container V contains toner that serves as an example of developer. A developing roller Ga that serves as an example of a developer holding body is rotatably supported in the developing container V. The developing roller Ga faces the photosensitive body PR in a developing region Q2.

Furthermore, a developing voltage is applied from the power source circuit E to the developing roller Ga. Augers Gb and Gc are rotatably supported in the developing container V. The augers Gb and Gc each serve as an example of a developer transport member.

The toner image forming device that forms a toner image on the photosensitive body PR includes the components such as the photosensitive body PR, the charging roller CR, the light exposure device ROS, and the developing device G.

One end of a replenishing path of a toner replenishing device TH1 is connected to the developing container V. The toner replenishing device TH1 that serves as an example of a developer replenishing device is secured to and supported by the printer U. The other end of the replenishing path of the toner replenishing device TH1 is connected to a toner cartridge TC that serves as an example of a container for developer.

The toner cartridge TC is detachable from and mountable to the printer U by removing and inserting in the front-rear direction.

Referring to FIG. 1, plural sheet feed trays TR1 to TR4 are provided in a lower portion of the printer U. The plural sheet feed trays TR1 to TR4 each serve as an example of a medium containing unit. The plural sheet feed trays TR1 to TR4 contain recording sheets S. Each of the sheets S serves as an example of a medium.

In FIG. 1, rails RL1 are disposed on the left and right sides of each of the sheet feed trays TR1 to TR4. The rails RL1 each serve as an example of a container guide member. Left and right end portions of the sheet feed trays TR1 to TR4 are movably supported by the rails RL1. Thus, each of the sheet feed trays TR1 to TR4 is supported by a corresponding pair of the left and right rails RL1 such that each of the sheet feed trays TR1 to TR4 is capable of being drawn and retracted in the front-rear direction.

Referring to FIG. 1, a sheet feed device K is disposed to the upper left of each of the sheet feed trays TR1 to TR4. The sheet feed devices K each include a pickup roller Rp that serves as an example of a medium pickup member. A separation roller set Rs that serves as an example of a separation member is disposed to the left of the pickup roller Rp. The separation roller set Rs includes a feed roller and a retard roller. The feed roller serves as an example of a medium transport member. The retard roller serves as an example of medium parting member.

A sheet feed path SH1 that serves as an example of a medium transport path is disposed to the left of the sheet feed devices K. The sheet feed path SH1 extends upward. Plural transport rollers Ra are disposed along the sheet feed path SH1. Each of the transport rollers serves as an example of a medium transport member. A registration roller Rr that serves as an example of a medium transport timing adjustment member is disposed at an upper end of the sheet feed path SH1, which is a downstream end of the sheet feed path SH1.

Furthermore, a manual feed tray TR0 that serves as an example of a manual feed unit is attached on a left side portion of the printer U. A left end of a manual feed path SH2 that serves as an example of a manual feed transport path is connected to a right portion of the manual feed tray TR0. A right end of the manual feed path SH2 is connected to the sheet feed path SH1.

Referring to FIG. 1, a transfer roller Rt that serves as an example of a transfer device is disposed above the registration roller Rr. The transfer roller Rt faces and is in contact with the photosensitive body PR in a transfer region Q3. Thus, the transfer roller Rt according to the first exemplary embodiment is rotated by rotation of the photosensitive body PR. A transfer voltage is applied from the power source circuit E to the transfer roller Rt.

The photosensitive-body cleaner CL is disposed on the downstream side of the transfer roller Rt in the rotational direction of the photosensitive body PR. A collection path CL4 that serves as an example of a developer transport path is supported by the photosensitive-body cleaner CL. The collection path CL4 extends from the photosensitive-body cleaner CL to the developing device G.

Referring to FIG. 1, a fixing device F is supported above the transfer roller Rt. The fixing device F includes a heating roller Fh and a pressure roller Fp. The heating roller Fh serves as an example of a heat fixing member. The pressure roller Fp serves as an example of a pressure fixing member. The heating roller Fh and the pressure roller Fp are in contact with each other in a fixing region Q4. A drive is transmitted from a drive source (not illustrated) to the heating roller Fh, thereby rotating the heating roller Fh. Also, power used to heat a heater (not illustrated) is supplied from the power source circuit E to the heating roller Fh.

An image recording section U2+Rt+F that records an image on the sheet S includes the process unit U2 that serves as an example of the toner image forming device, the transfer roller Rt, and the fixing device F.

A sheet guide F1 that serves as an example of a medium guide unit is formed on the upper portion of the fixing device F. Sheet output rollers R1 are disposed to the right of the sheet guide F1. The sheet output rollers R1 each serve as an example of a medium output member. A medium output opening Ha is formed to the right of the sheet output rollers R1. The first output tray TRh is disposed below the medium output opening Ha.

Referring to FIG. 1, a connection path SH3 that serves as an example of a medium transport path is disposed at a position above the fixing device F and to the left of the sheet output rollers R1. The connection path SH3 extends leftward from the medium output opening Ha.

An inversion unit U3 that serves as an example of a medium inversion device is supported above the manual feed tray TR0 on the left side surface of the printer body U1. An inversion path SH4 that serves as an example of a medium transport path is formed in the inversion unit U3. An upper end of the inversion path SH4 is connected to a left end of the connection path SH3. A lower end of the inversion path SH4 is merged with the sheet feed path SH1 on the upstream of the registration roller Rr.

Furthermore, a second output path SH6 that serves as an example of a medium transport path is formed in an upper portion of the inversion unit U3. A right end of the second output path SH6 is connected to the connection path SH3. The second output path SH6 branches from the inversion path SH4. A left end of the second output path SH6 extends to a left side surface of the inversion unit U3. A face up tray TRh1 that serves as an example of a second output unit is supported on the left side surface of the inversion unit U3. Thus, the sheet S having passed through the second output path SH6 is able to be output to the face up tray TRh1.

Functions of the Image Forming Apparatus

Image information transmitted from the personal computer PC is input to the controller C of the printer U according to the first exemplary embodiment having the above-described structure. The controller C converts the image information input thereto into latent image forming information at preset timing and outputs the latent image forming information to the writing circuit DL. The light exposure device ROS outputs the laser beam L in accordance with a signal received by the writing circuit DL. The controller C controls operations of the operation unit UI, the writing circuit DL, the power source circuit E, and so forth.

Referring to FIGS. 1 and 2, a surface of the photosensitive body PR is charged by the charging roller CR to which the charging voltage is applied. The surface of the photosensitive body PR charged by the charging roller CR is irradiated with and scanned by the laser beam L from the light exposure device ROS in the writing region Q1, thereby an electrostatic latent image is formed. The surface of the photosensitive body PR on which the electrostatic latent image has been formed sequentially passes through the developing region Q2 and the transfer region Q3.

The developing roller Ga faces the photosensitive body PR in the developing region Q2. The developing roller Ga is rotated while holding developer in the developing container V on the surface of the developing roller Ga. Thus, the electrostatic latent image on the surface of the photosensitive body PR is developed into a toner image by the toner held on the surface of the developing roller Ga. The toner image serves as an example of a visual image. The developer in the developing container V is circulated while being agitated by the augers Gb and Gc.

As the development is performed with the developing roller Ga, the developer in the developing container V is consumed. As the developer in the developing container V is consumed, the developing container V is replenished with the developer from the toner cartridge TC. That is, in accordance with the amount of consumed developer, the toner in the cartridge TC is transported to the discharge port TC3. The toner discharged through the discharge port TC3 is transported to the developing container V by a replenishing transport member (not illustrated) in the replenishing path of the toner replenishing device TH1.

The sheets S on which images are to be recorded are contained in the sheet feed trays TR1 to TR4. The sheets S contained in the sheet feed trays TR1 to TR4 are picked up by the pickup rollers Rp of the sheet feed devices K. The separation roller sets Rs each separate one sheet after another from the sheets S having been picked up by a corresponding one of the pickup rollers Rp. Each of the sheets S having been separated by the separation roller sets Rs is fed into the sheet feed path SH1. The sheet S is transported toward the registration roller Rr by the transport rollers Ra through the sheet feed path SH1.

The sheet S fed from the manual feed tray TR0 is transported to the registration roller Rr through the manual feed path SH2. The sheet S having been transported to the registration roller Rr is transported to the transfer region Q3 by the registration roller Rr at timing adjusted to timing at which the toner image on the surface of the photosensitive body PR is moved to the transfer region Q3.

The toner image on the surface of the photosensitive body PR is transferred onto the sheet S that is passing through the transfer region Q3 by the transfer roller Rt to which the transfer voltage is applied in the transfer region Q3.

Referring to FIG. 2, the toner attracted to the surface of the photosensitive body PR having passed through the transfer region Q3 is removed by the photosensitive-body cleaner CL. Thus, the photosensitive body PR is cleaned. The toner removed by the photosensitive-body cleaner CL is returned into the developing container V through the collection path CL4. That is, the developer collected by the photosensitive-body cleaner CL is reused by the developing device G.

After the surface of the photosensitive body PR has been cleaned by the photosensitive-body cleaner CL, the photosensitive body PR is charged again by the charging roller CR.

The sheet S onto which the toner image has been transferred in the transfer region Q3 is transported to the fixing region Q4 of the fixing device F. At this time, the toner image on the sheet S has not been fixed.

The sheet S is interposed between the heating roller Fh and the pressure roller Fp in the fixing region Q4, so that the toner image is heat fixed.

The sheet S onto which the toner image has been fixed by the fixing device F is guided by the sheet guide F1 so as to be transported to the sheet output rollers R1. In the case where the sheet S is output to the first output tray TRh, the sheet S having been fed to the sheet output rollers R1 is output to the first output tray TRh through the medium output opening Ha.

In the case where duplex printing is performed, the sheet output rollers R1 are rotated in the reverse direction when a trailing end in a transport direction of the sheet S has passed through the sheet guide F1. At this time, the image has been recorded on a first side of this sheet S. Thus, the sheet S is transported into the inversion path SH4 through the connection path SH3. The sheet S having been transported through the inversion path SH4 is transported in the inverted state to the registration roller Rr. Thus, the sheet S is transported from the registration roller Rr to the transfer region Q3 again, and an image is recorded in a second side of the sheet S.

When the sheet S is output to the face up tray TRh1, the sheet S transported through the connection path SH3 by the reverse rotation of the sheet output rollers R1 is transported into the second output path SH6. The sheet S having been transported through the second output path SH6 is output to the face up tray TRh1.

Description of the Toner Cartridge

Figure 3:
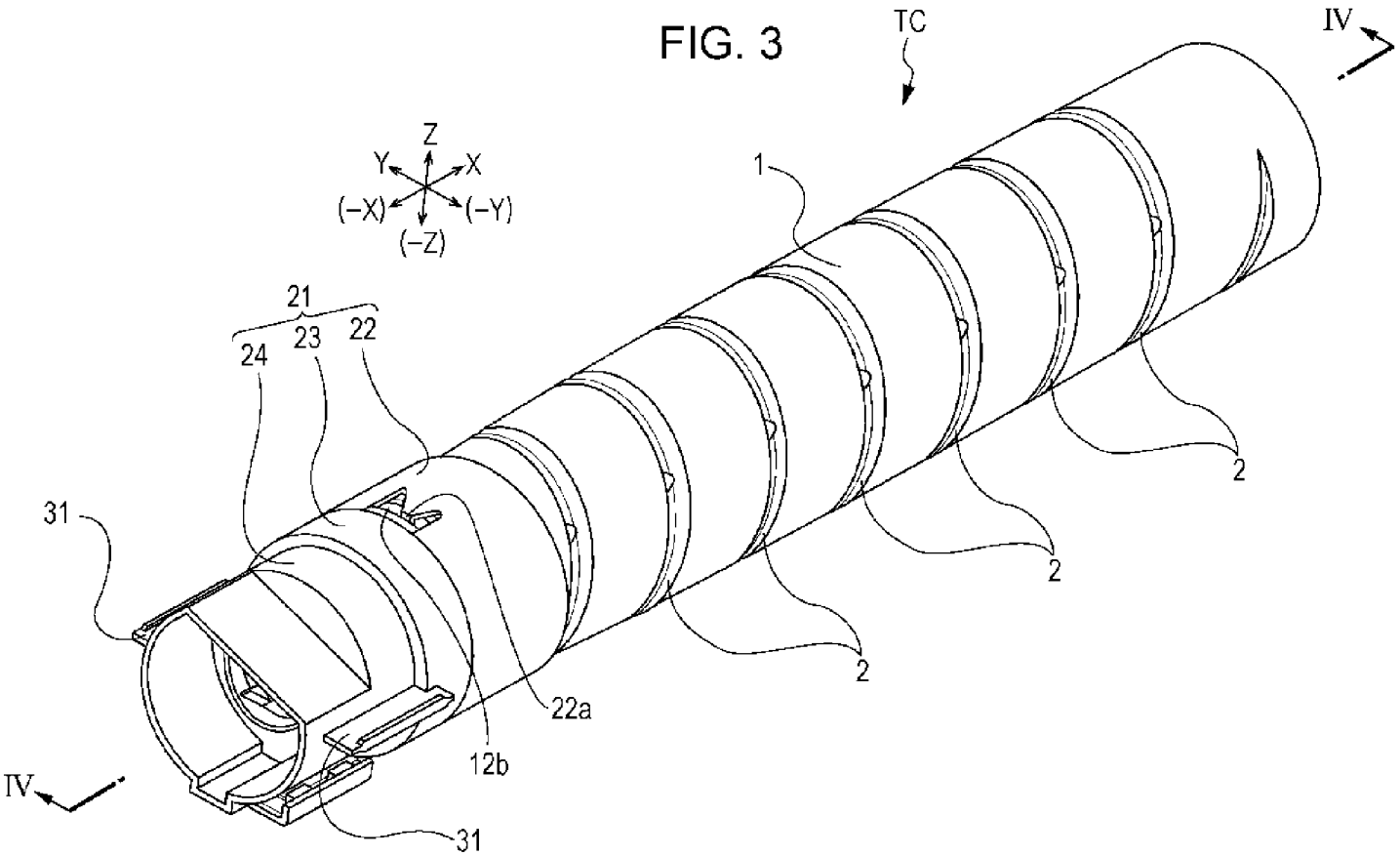
FIG. 3 is a perspective view of a toner cartridge according to the first exemplary embodiment.

FIG. 3 is a perspective view of the toner cartridge according to the first exemplary embodiment.

Figure 4:
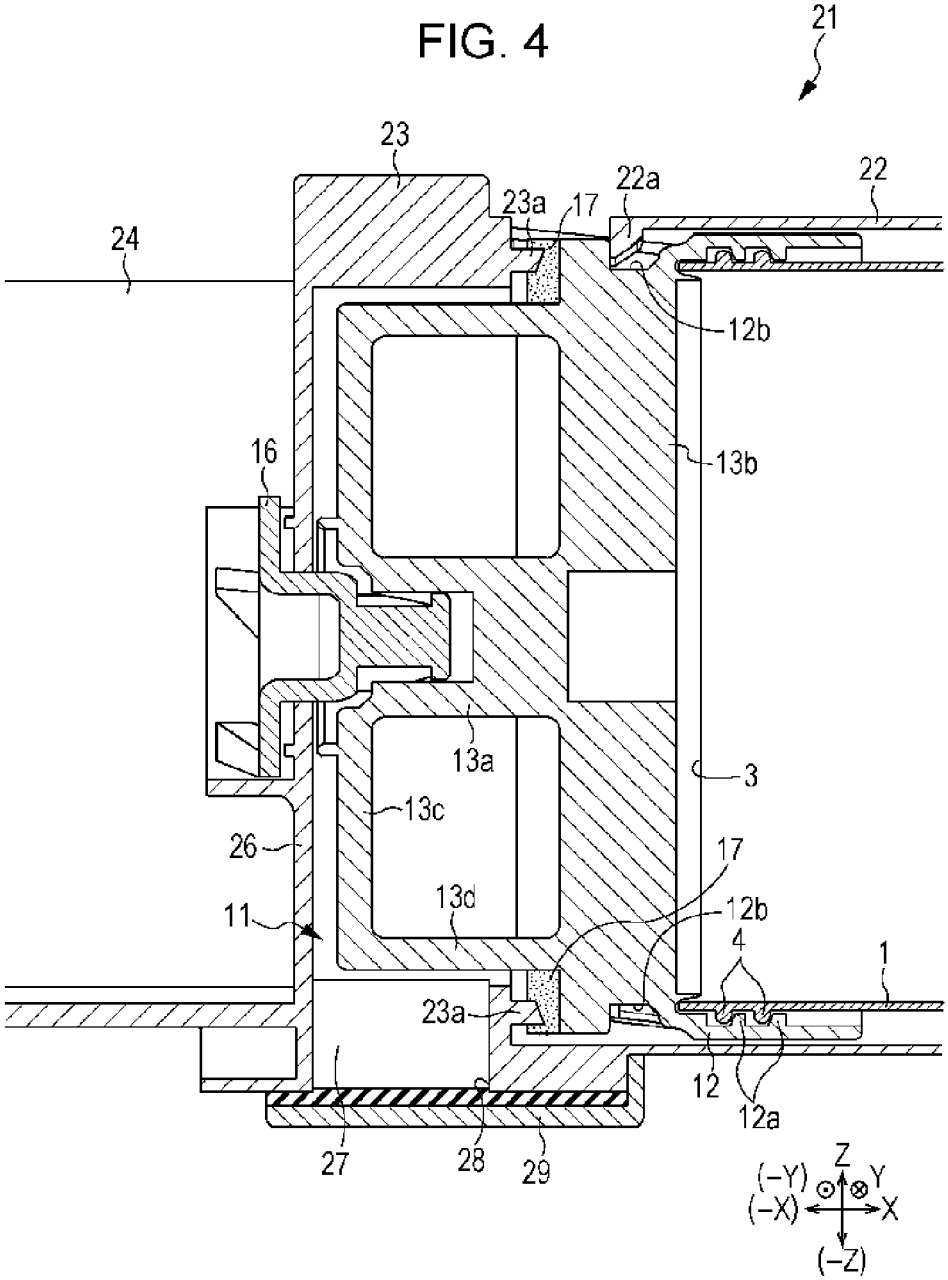
FIG. 4 is a sectional view of the toner cartridge illustrated in FIG. 3 taken along line IV-IV illustrated in FIG. 3.

FIG. 4 is a sectional view of the toner cartridge illustrated in FIG. 3 taken along line IV-IV illustrated in FIG. 3.

Referring to FIGS. 3 to 4, the toner cartridge TC according to the first exemplary embodiment includes a bottle 1 that serves as an example of a container body. The bottle 1 has a cylindrical shape extending in the front-rear direction and is capable of containing the developer therein. The bottle 1 has a helical groove portion 2 that serves as an example of a transport portion in its wall surface. Referring to FIGS. 3 and 4, the bottle 1 has an opening 3 at its rear end. A screw portion 4 that serves as an example of a fastening portion is formed on the front side of the opening 3 in an outer surface of the bottle 1.

Figure 5:
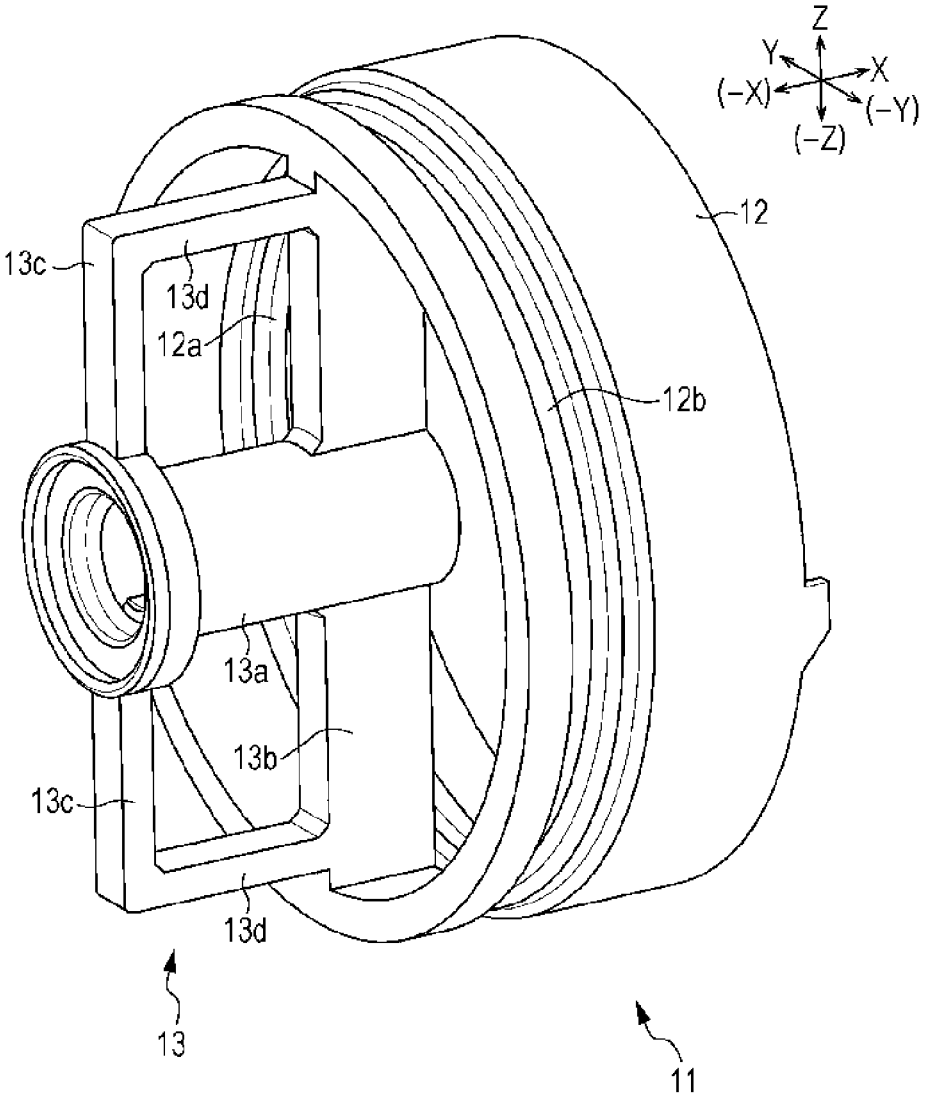
FIG. 5 is an explanatory view of a fin member according to the first exemplary embodiment.

FIG. 5 is an explanatory view of a fin member according to the first exemplary embodiment.

Referring to FIGS. 3 to 5, a fin member 11 that serves as an example of a crumbling member is disposed behind the bottle 1. The fin member 11 includes a cylindrical portion 12 on the front side and a fin body 13 on the rear side. The cylindrical portion 12 has a screw portion 12*a* that serves as an example of a fastening portion in its inner circumferential surface. The screw portion 12*a* corresponds to the screw portion 4. Accordingly, the screw portion 12*a* and the screw portion 4 are engaged with each other, thereby fastening the fin member 11 and the bottle 1 to each other. Thus, a rotating body 1+11 of the first exemplary embodiment is formed of the fin member 11 and the bottle 1.

Furthermore, a ring-shaped recess 12*b* is formed at a rear portion of an outer circumference of the cylindrical portion 12.

The fin body 13 includes a shaft portion 13*a* that extends in the front-rear direction. Support arms 13*b* that extend outward in the radial directions are formed at a front end of the shaft portion 13*a*. The support arms 13*b* each serve as an example of a crumbling part and each also serve as an example of a portion to be supported. Outer ends of the support arms 13*b* are connected to the inner circumferential surface of the cylindrical portion 12.

First crumbling parts 13*c* that extend outward in the radial directions are formed on a rear portion of the shaft portion 13*a*. Second crumbling parts 13*d* that extend in the front-rear direction are formed between outer ends of the first crumbling parts 13*c* in the radial directions and the support arms 13*b*.

A coupling 16 that serves as an example of a drive receiving member is supported at a rear end of the shaft portion 13*a*. When the toner cartridge TC is mounted to the printer body U1, the coupling 16 is engaged with a coupling supported by the printer body U1, thereby receiving drive.

Figure 6:
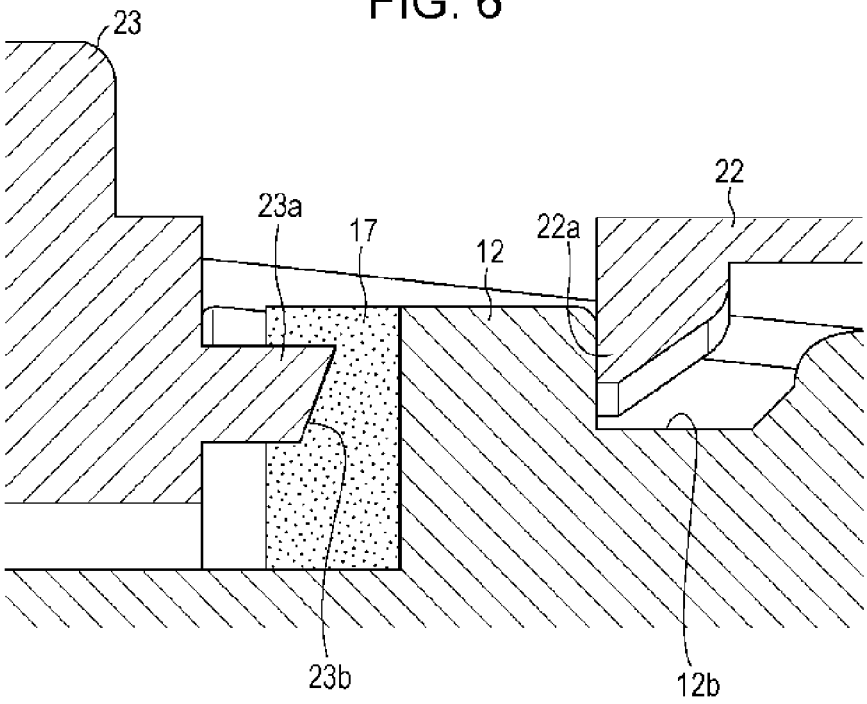
FIG. 6 is an enlarged view of part of a leakage suppressing portion illustrated in FIG. 4.

FIG. 6 is an enlarged view of part of a leakage suppressing portion of FIG. 4.

Referring to FIGS. 4 to 6, a toner seal 17 that serves as an example of an anti-leakage member is supported at a rear end surface of the cylindrical portion 12. The toner seal 17 has an annular shape, that is, a so-called ring shape formed along the rear end surface of the cylindrical portion 12. The toner seal 17 is formed of any material capable of suppressing leakage of the developer. For example, the toner seal 17 may be formed of a foamed member such as a sponge.

A flange member 21 that serves as an example of a discharge member is supported around the fin member 11. The flange member 21 has a cylindrical shape. The flange member 21 includes a middle diameter portion 22 disposed at the front thereof, a large diameter portion 23 disposed at the center thereof in the front-rear direction, and a small diameter portion 24 disposed at the rear thereof.

The middle diameter portion 22 has an inner diameter that is sufficient to cover a rear portion of an outer circumference of the rotating body 1+11. The middle diameter portion 22 has a claw portion 22*a* that serves as an example of a connecting portion. The claw portion 22*a* is disposed at a position corresponding to the ring-shaped recess 12*b* and extends inward in the radial direction. The claw portion 22*a* is in contact with the recess 12*b* so as to regulate a forward movement of the rotating body 1+11 relative to the flange member 21. That is, the claw portion 22*a* connects the rotating body 1+11 and the flange member 21 to each other.

A ring-shaped projection 23*a* that serves as an example of a compressing portion is formed at a front end of the large diameter portion 23. The projection 23*a* according to the first exemplary embodiment has an inclined surface 23*b*. The height of the inclined surface 23*b* increases toward the outer side in the radial direction from the rotational center of the rotating body 1+11. Thus, when the flange member 21 and the rotating body 1+11 are connected to each other, the projection 23*a* is supported such that the projection 23*a* is pressed against the toner seal 17 so as to compress the toner seal 17. In this state, a compressing amount is larger on the outer side than on the inner side in the radial direction.

A plate-shaped wall portion 26 that extends in the up-down direction and the left-right direction is formed at a boundary between the large diameter portion 23 and the small diameter portion 24. The coupling 16 that penetrates through the wall portion 26 is rotatably supported by the wall portion 26.

A discharge channel 27 that extends downward is formed on the lower side of the wall portion 26. A discharge port 28 that serves as an example of a discharge port is formed at a lower end of the discharge channel 27.

A shutter 29 that serves as an example of an opening and closing member is supported below the discharge channel 27 so as to be movable in the front-rear direction. The shutter 29 moves between an open position and a closed position. The shutter 29 opens the discharge port 28 at the open position and closes the discharge port 28 at the closed position as the toner cartridge TC is inserted and removed. Various known related-art structures may be adopted for the structure for moving the shutter 29 as the toner cartridge TC is inserted and removed. Thus, the detailed description of the structure for moving the shutter 29 is omitted.

Referring to FIG. 3, insertion guides 31 that each serve as an example of a portion to be guided are formed on an outer circumferential surface of the small diameter portion 24. The insertion guides 31 are guided by guiding portions (not illustrated) provided in the printer body U1 that serves as the example of the image forming apparatus body when mounting the toner cartridge TC.

Operation of the First Exemplary Embodiment

In the printer U according to the first exemplary embodiment having the above-described structure, in a state in which the toner cartridge TC has been mounted to the printer body U1, the rotating body 1+11 is rotated when the drive is transmitted to the coupling 16 in accordance with consumption of the toner. When the bottle 1 is rotated, the developer is transported rearward along the helical groove portion 2. Thus, a rotating transport member is not necessarily required in the bottle of the toner cartridge TC according to the first exemplary embodiment, and accordingly, the manufacturing cost of the toner cartridge TC may be reduced.

The toner replenishing device TH1 is replenished with the developer transported rearward along with rotation of the bottle 1 through the discharge port 28. When the bottle 1 is rotated, the fin body 13 is also rotated. Thus, the toner closely accumulated and clumped near the discharge port 28 is crumbled or loosened. Accordingly, compared to a structure without the fin body 13, the likelihood of the developer being clumped near the discharge port 28 and clogging of the discharge port 28 due to the developer is reduced.

Figure 7A:
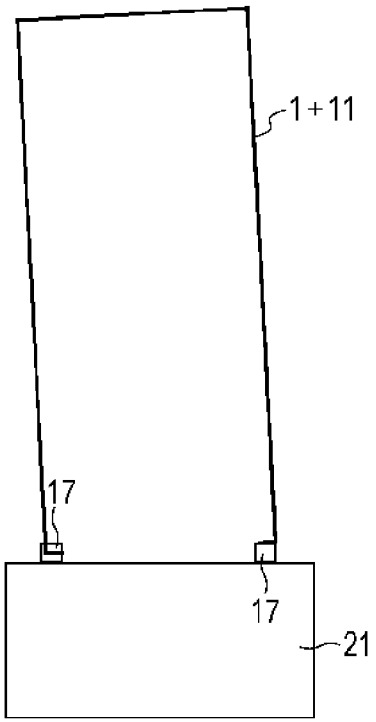
FIGS. 7A to 7C are explanatory views of operations according to the first exemplary embodiment, and out of FIGS. 7A to 7C.
Figure 7B:
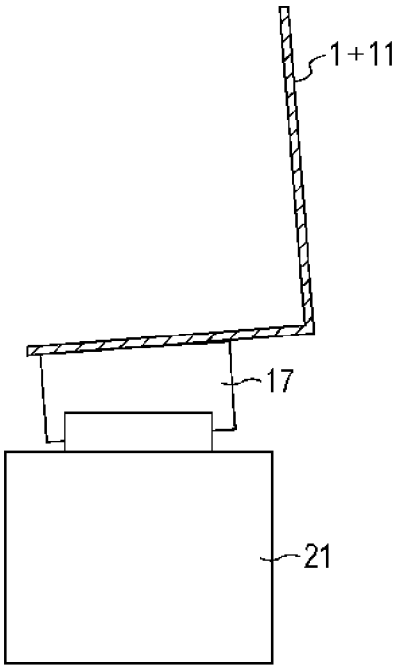
Figure 7C:
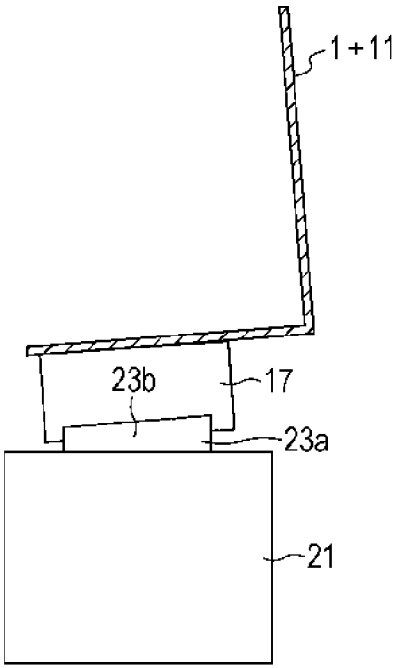

FIGS. 7A to 7C are explanatory views of operations according to the first exemplary embodiment. Out of FIGS. 7A to 7C, FIG. 7A is the explanatory view of a state in which the rotating body is inclined, FIG. 7B is the explanatory view of part around the seal of a related-art structure, and FIG. 7C is the explanatory view of part around the seal according to the first exemplary embodiment.

As illustrated in FIG. 7A, when the toner cartridge TC according to the first exemplary embodiment is mounted to the printer body U1, the toner cartridge TC may be mounted with the rotating body 1+11 inclined relative to the flange member 21 due to tolerances, play, and so forth. In this state, the compression on the outer side in the radial direction in the portion of the toner seal 17 may be insufficient with the related-art structure as illustrated in FIG. 7B. Consequently, a pressure for tight closing may be insufficient particularly on the outer side in the radial direction. This may lead to the leakage of the developer.

In contrast, according to the first exemplary embodiment, the height of the projection 23*a* increases toward the outer side in the radial direction. Thus, as illustrated in FIG. 7C, even when the rotating body 1+11 is inclined, the compressing amount on the outer side in the radial direction may be likely to be ensured, and accordingly, the insufficiency in pressure may be reduced. Thus, the leakage of the developer may be reduced.

Second Exemplary Embodiment

Figure 8:
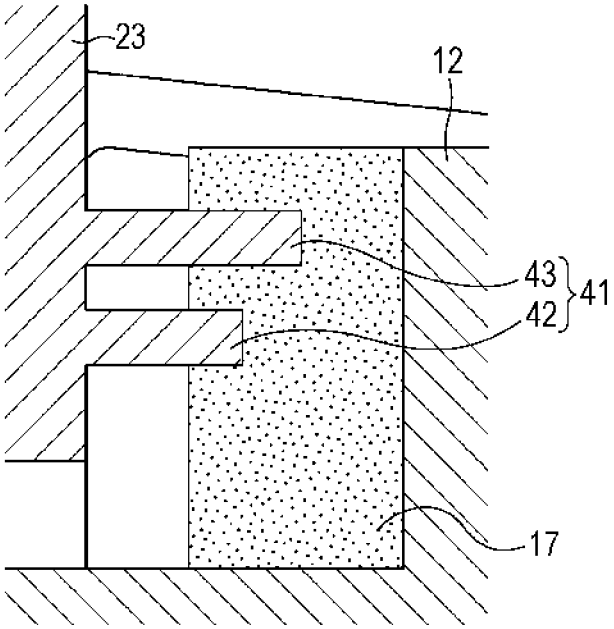
FIG. 8 is for explaining a toner cartridge according to a second exemplary embodiment and corresponds to FIG. 4 of the first exemplary embodiment.

FIG. 8 is for explaining a toner cartridge according to a second exemplary embodiment and corresponds to FIG. 4 of the first exemplary embodiment.

Next, the second exemplary embodiment of the present invention will be described. In this description of the second exemplary embodiment, elements corresponding to those of the first exemplary embodiment are denoted by the same reference signs and detailed description thereof is omitted.

Although the second exemplary embodiment is different from the first exemplary embodiment in the following points, the second exemplary embodiment has a structure that is the same as or similar to that of the first exemplary embodiment in other points.

Referring to FIG. 8, the toner cartridge TC according to the second exemplary embodiment has a projection 41 serving as an example of the compressing portion instead of the projection 23*a* according to the first exemplary embodiment. The projection 41 according to the second exemplary embodiment includes a first projection 42 and a second projection 43. The first projection 42 is disposed on the inner side in the radial direction and serves as an example of a first compressing portion. The second projection 43 is disposed on the outer side in the radial direction and serves as an example of a second compressing portion having a higher height than that of the first compressing portion.

Also with the printer U according to the second exemplary embodiment having the above-described structure, even when the toner cartridge TC is mounted with the rotating body 1+11 inclined, the compressing amount may be likely to be ensured by the outer second projection 43, and accordingly, the leakage of the developer may be reduced as is the case with the first exemplary embodiment.

Variations

Although the exemplary embodiments of the present invention have been described in detail, embodiments of the present invention are not limited to the above-described exemplary embodiments. Many variations are possible without departing from the gist of the present invention described in the claims. Examples of variations (H01 to H07) of embodiments of the present invention are described below.

H01: According to the above-described exemplary embodiments, the printer is described as the example of the image forming apparatus. However, the image forming apparatus is not limited to the printer. The image forming apparatus is applicable to, for example, an image forming apparatus of any one of a copier, a facsimile machine, and so forth.

H02: According to the above-described exemplary embodiments, an example structure is described in which the flange member 21 is disposed on the leading end side in the mounting direction of the toner cartridge TC, that is, on the rear side of the printer body U1. However, this is not limiting. For example, a structure is also possible in which the flange member 21 and so forth are disposed on a trailing end side in the mounting direction, that is, on the front side of the printer body U1.

H03: The sum of the numbers of the projections 42 and 43 of the second exemplary embodiment is not limited to two and may be three or more.

H04: The first and second exemplary embodiments of the above-described exemplary embodiments may be combined. That is, end surfaces of the projections 42 and 43 according to the second exemplary embodiment may be inclined similarly to the inclined surface 23*b* according to the first exemplary embodiment.

H05: According to the above-described exemplary embodiments, although the fin member 11 that crumbles the developer may be provided, the fin member 11 may be omitted. Furthermore, although an example structure including two support arms 13*b* is described as the fin member 11, this is not limiting. The fin member 11 may include three or more support arms 13*b*.

H06: According to the exemplary embodiments, an example structure is described in which the coupling 16 that drives the bottle 1 is provided at the rear end. However, this is not limiting. For example, a structure is possible in which a coupling form is formed at the front end of the bottle 1 or in which a gear is formed on the outer circumferential surface of the bottle 1 so as to rotate the bottle 1.

H07: Although examples are described in which the toner seal 17 is disposed on the rotating body 1+11 side and the projection 23*a* or 41 is disposed on the flange member 21 according to the above-described exemplary embodiments, positions of the toner seal 17 and the projection 23*a* or 41 may be exchanged.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A container for developer detachably mountable to an image forming apparatus body, the container comprising:

a rotating body containing developer and being rotated about a rotational axis when drive is transmitted from the image forming apparatus body;

a discharge member supporting the rotating body such that the rotating body is rotatable relative to the discharge member and comprising a discharge port through which the developer is discharged;

an anti-leakage member disposed at one of the rotating body and the discharge member and configured to suppress leakage of the developer; and a compressing portion disposed at the other of the rotating body and the discharge member and comprising:

a first surface; and a second surface farther from the rotational axis of the rotating body than the first side, wherein the compressing portion is pressed against the anti-leakage member so as to compress the anti-leakage member such that a compressing amount is larger on the second side than on the first side, wherein the compressing portion has an inclined surface formed such that the compressing amount increases as a distance between a portion of the inclined surface and the rotational axis increases, and wherein a length of the second surface of the compressing portion that is provided at a farthest position from the rotational axis is longer than a length of the first surface of compressing portion that is provided a nearest position from the rotational axis.

2. The container according to claim 1, wherein the compressing portion includes a first compressing portion and a second compressing portion disposed farther from the rotational center than the first compressing portion, and wherein the compressing amount is larger in the second compressing portion than in the first compressing portion.

3. An image forming apparatus comprising:

an image holding body having a surface;

a developing device configured to develop a latent image formed on the surface of the image holding body into a visual image; and the container according to claim 1 that contains the developer with which the developing device is replenished.

* * * * *